US009882273B2

(12) United States Patent
Tonn

(10) Patent No.: US 9,882,273 B2
(45) Date of Patent: Jan. 30, 2018

(54) BUOYANT HELICAL TWIN-AXIAL WIRE ANTENNA

(71) Applicant: David A Tonn, Charlestown, RI (US)

(72) Inventor: David A Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/351,927

(22) Filed: Nov. 15, 2016

(65) Prior Publication Data

US 2017/0062916 A1 Mar. 2, 2017

Related U.S. Application Data

(62) Division of application No. 14/280,889, filed on May 19, 2014, now Pat. No. 9,553,366.

(51) Int. Cl.

| | |
|---|---|
| ***H01Q 13/10*** | (2006.01) |
| ***H01Q 1/34*** | (2006.01) |
| ***H01Q 5/321*** | (2015.01) |
| ***H01Q 1/04*** | (2006.01) |
| ***H01Q 1/36*** | (2006.01) |
| ***H01Q 1/48*** | (2006.01) |

(52) U.S. Cl.

CPC ..... *H01Q 1/34* (2013.01); *H01Q 1/04* (2013.01); *H01Q 1/362* (2013.01); *H01Q 1/48* (2013.01); *H01Q 5/321* (2015.01)

(58) Field of Classification Search

CPC ..... H01Q 13/203; H01Q 1/34; H01Q 1/04

USPC ..... 343/770, 853, 709

See application file for complete search history.

(56) References Cited

U.S. PATENT DOCUMENTS 6,870,508 B1 * 3/2005 Rivera ..... H01Q 1/04 343/709

2011/0279336 A1 * 11/2011 Tonn ..... H01Q 1/34 343/709

* cited by examiner

*Primary Examiner* — Dameon E Levi

*Assistant Examiner* — Collin Dawkins

(74) *Attorney, Agent, or Firm* — James M. Kasischke; Michael P. Stanley

(57) ABSTRACT

An antenna includes a polymer coating having a VLF/LF element and an HF/VHF element embedded therein. A blocking choke is interposed between the VLF/LF element and the antenna feed t block HF/VHF signals. Small chokes are regularly positioned on the VLF/LF element to eliminate resonances caused by mutual capacitance between the elements. Reactive loads are positioned in said HF/VHF element at regular intervals for optimizing performance of the antenna in the HF/VHF radio bands. In further embodiments the antenna is provided as a floating antenna with the elements helically arranged therein.

4 Claims, 3 Drawing Sheets

BUOYANT HELICAL TWIN-AXIAL WIRE ANTENNA

CROSS REFERENCE TO OTHER PATENT APPLICATIONS

This application is a divisional application and claims the benefit of the filing date of U.S. patent application Ser. No. 14/280,889; filed on May 19, 2014; and entitled "Twin-Axial Wire Antenna" by the inventor, David A. Tonn.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention is directed to a linear antenna for dual frequencies and a method for designing such an antenna and more particularly to a twin-axial floating antenna that can be deployed from a vessel.

(2) Description of the Prior Art

Previous work on buoyant cable antenna (BCA) improvements have led to antennas that have improved performance in the HF band (e.g., U.S. Pat. No. 7,868,833 entitled "Ultra wideband buoyant cable antenna element") but this improvement came at the expense of the performance of the antenna in the VLF/LF band (10 kHz-200 kHz. This occurred because the methods involved required the use of series capacitive loading along the length of the antenna wire. This creates a high pass filter in the antenna and prevents current flow in the VLF/LF bands.

U.S. Pat. No. 8,203,495, entitled "Modular VLF/LF and HF buoyant cable antenna and method" introduces a useful method of including the VLF/LF capability back into the antenna. In this patent, the VLF/LF signals are received on the braid of a piece of coaxial cable that is connected in series with the loaded HF antenna. However, this method suffers from two major shortfalls. The first is that the attenuation of the coaxial cable hinders the gain of the HF antenna, since HF signals must pass through the coaxial cable to reach the overall antenna feed point. The second is that the overall antenna length increases to over 150 feet long, which is undesirable from a mechanical point of view since it affects the speed-depth curves and hinders the submarine's operations when using the antenna.

SUMMARY OF THE INVENTION

It is a first object of the present invention to provide an antenna capable of operating in both HF/VHF and VLF/LF bands;

Another object is to provide such an antenna having good performance in the HF band while not sacrificing performance in the VLF band; and Yet another object is to provide an antenna having a shorter length than known with series arrangements.

Accordingly, there is provided an antenna that includes a polymer coating having a VLF/LF element and an HF/VHF element embedded therein. A blocking choke is interposed between the VLF/LF element and the antenna feed to block HF/VHF signals. Small chokes are regularly positioned on the VLF/LF element to suppress resonances in the HF/VHF bands caused by mutual capacitance between the elements. Reactive loads are positioned in said HF/VHF element at regular intervals for optimizing performance of the antenna in the HF/VHF radio bands. In further embodiments the antenna is provided as a floating antenna with the elements helically arranged therein.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

This invention combines the functionality of the two legacy buoyant cable antenna elements into a single antenna element while also providing for improved gain in the high frequency (HF, between 3 MHz and 30 MHz) and very high frequency (VHF, between 30 MHz and 300 kHz) radio bands to support improved communications for submerged submarines.

Figure 1:
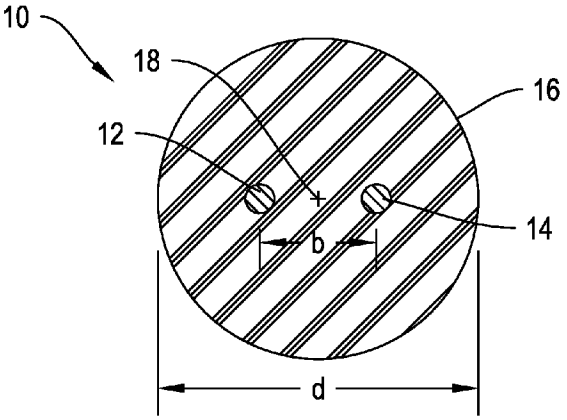
FIG. 1 is a cross-sectional view of an antenna.
Figure 2:
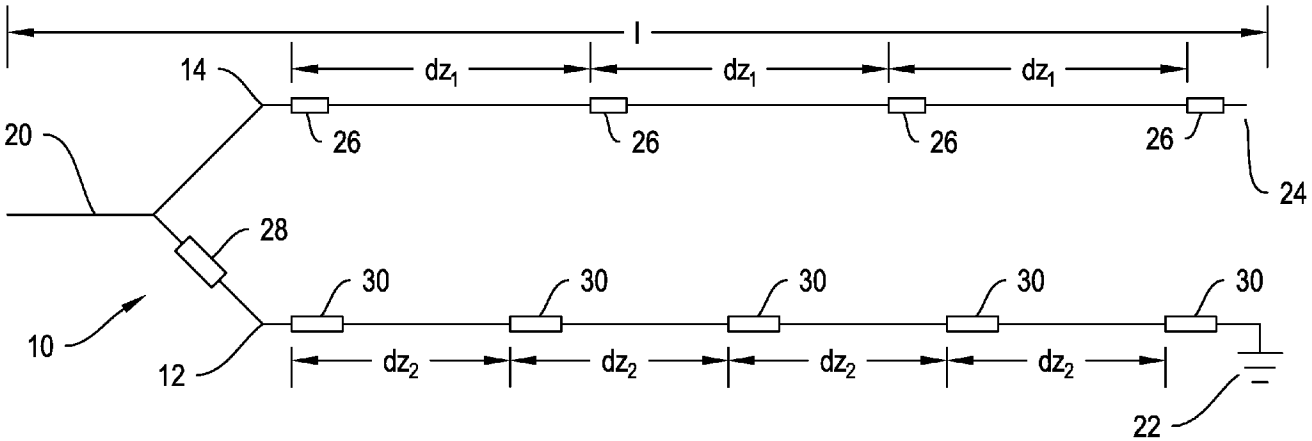
FIG. 2 is a diagram of a typical antenna.

An embodiment shown in FIGS. 1 and 2 overcomes limitations found in the prior art by utilizing a twin-axial geometry. As shown in FIG. 1, this antenna 10 employs two center conductors, a VLF conductor 12 and an HF conductor 14, instead of one in the prior art. The antenna 10 has a cylindrical geometry with a circular cross section of constant diameter d maintained over the length, l, of the antenna. Conductors 12 and 14 are embedded in a body 16 made from any polymer foam. The polymer foam should be positively buoyant in seawater, electrically insulating, chemical resistant and durable in normal seawater temperatures. Many different polymer foams are suitable for this purpose.

Antenna conductors 12 and 14 are embedded into body 16 and arranged so that their centroid is coincident with the axis 18 of the antenna over its entire length. The conductors 12 and 14 are, therefore, positioned on either side of the center 18 of antenna body 16, as shown in FIG. 1. The conductors 12 and 14 can be arranged parallel to one another or can be positioned helically at a constant pitch angle. In either embodiment, the spacing between the conductors, b, is constant along the entire length of the antenna 10. In one embodiment, the HF conductor 12 and the VLF conductor 14 each have the same gauge and are made from stranded conductors. In alternate embodiments, the two conductors 12 and 14 can be of differing gauges and can be either stranded or solid. In a prototype, both conductors were made from #22 solid copper wire arranged parallel to each other within a body 16.

Each of the conductors 12 and 14 carries signals from a separate portion of the radio spectrum. An antenna feed 20 is located at the proximate end of each conductor and is electrically joined to radio equipment (not shown). The VLF conductor 12 carries VLF/LF signals. At its distal end, VLF conductor 12 connects to environmental ocean water by means of a grounding ring 22. Grounding ring 22 is a short-circuit termination electrically connected to environmental water which is assumed to be at ground potential. The HF conductor 14 carries signals in the HF/VHF band and terminates at its distal end in an open circuit termination 24 prior to the end of the antenna 10. In another embodiment, open circuit termination 24 can terminate at the end of the antenna 10. Open circuit termination 24 cannot electrically connect to grounding ring 22. This is necessary for maximum gain in the HF band.

To provide optimal HF/VHF performance, the HF conductor 14 is provided with a reactive load 26 at regular intervals along its length, $dz_1$. Reactive load 26 can be made from a single capacitor, a single capacitor and a single inductor connected in parallel, or a combination of these types of reactive loads. Reactive loads 26 are inserted in series with the HF conductor 14. In some embodiments, parallel capacitor inductor reactive loads can be used for one portion of the HF conductor 14, while the remainder of the HF conductor 14 uses capacitors alone. The capacitor and inductor are selected so as to optimize the performance of the antenna in the HF and VHF bands. In the prototype, single capacitors having a capacitance of 680 pF were used, with the distance between reactive loads, $dz_1$, being 1 meter apart.

The VLF conductor 12 connects to the HF conductor 14 at antenna feed 20 through a blocking choke 28. Blocking choke 28 is preferably a ferrite core shielded inductor chosen to keep applied signals in the HF and VHF bands from passing into the VLF/LF conductor 12.

Due to the mutual capacitance between the VLF conductor 12 and HF conductor 14, HF and VHF signals can couple from the HF conductor 14 onto the VLF conductor 12 and cause VLF conductor 12 to resonate. The resonance of the VLF conductor 12 can affect the gain and impedance of the HF conductor 14 detrimentally. This resonance is suppressed by electrically interrupting the VLF conductor 12 at regular intervals by providing small chokes 30 at locations in conductor 12. Small choke 30 is chosen so that its impedance is high enough to stop the flow of current on the VLF conductor 12 but no so high as to impede the flow of current in the VLF/LF bands. The spacing between adjacent small chokes 30, $dz_2$, was chosen to be smaller than one-half of the shortest wavelength in the band or bands of operation of the HF conductor 14. In this way, the segments of the VLF conductor 12 interconnecting chokes 30 are sub-resonant. In the prototype, blocking choke 28 had a value of 22 μH, and small chokes 30 all had a value of 1 μH.

Figure 3:
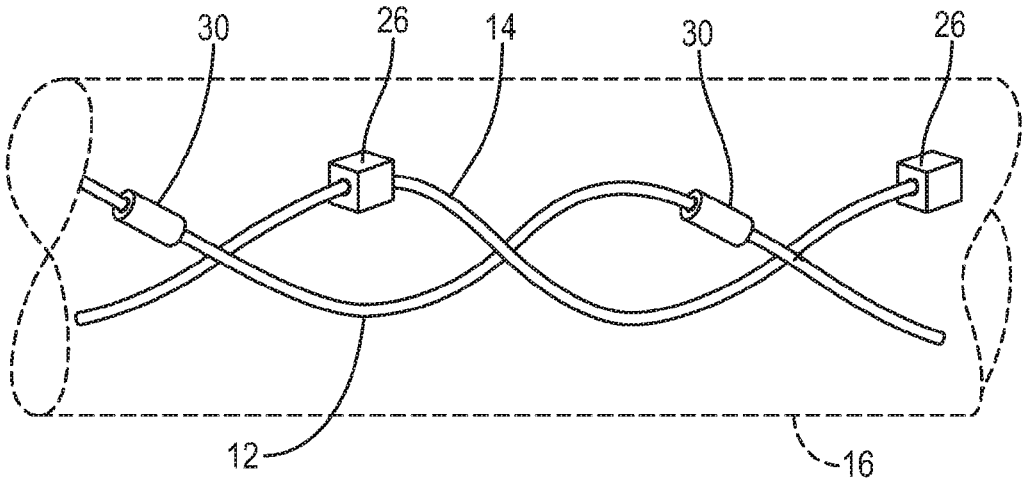
FIG. 3 is a view of a section of an antenna.

FIG. 3 shows a preferred embodiment of the invention, where the two wires are arranged as a twisted pair of constant pitch angle. FIG. 3, with the reactive loads 26 placed periodically along the HF/VHF wire 14 and the small chokes 30 placed repeatedly along the VLF/LF wire 12, with the entire assembly centered within a polymer foam jacket 16. Polymer foam jacket 16 is provided with hidden lines to show VLF/LF wire 12 and HF/VHF wire 14 within. While reactive loads 26 and chokes 36 should be positioned periodically on wire 14 and wire 12, the placement period is not required to be the same for each wire 14 and 12.

Figure 4:
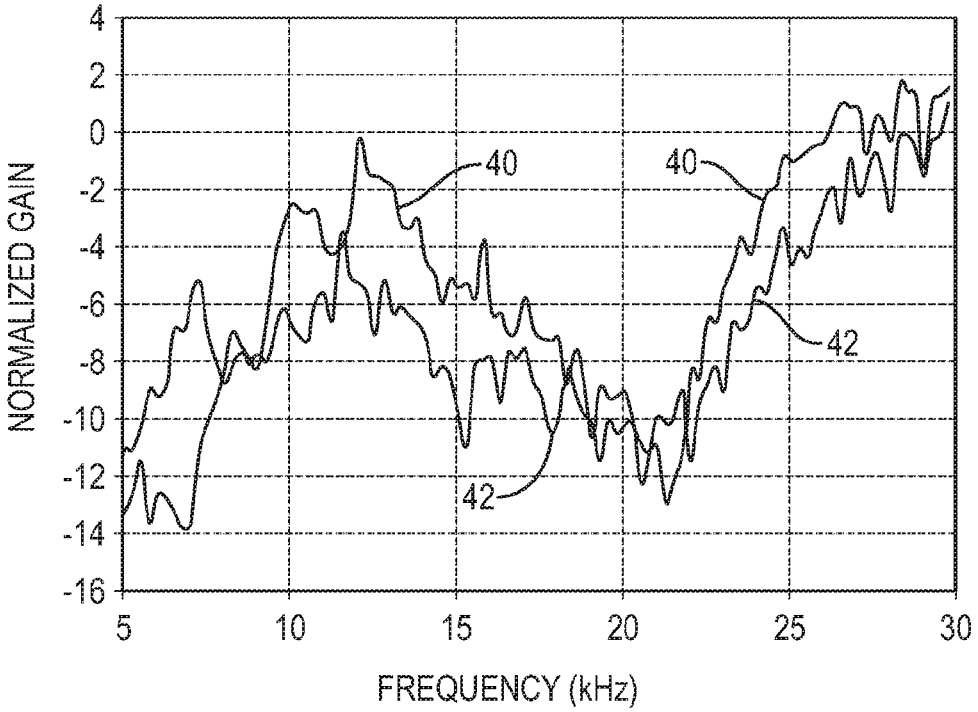
FIG. 4 is graph showing normalized performance gains of the current antenna over a prior art antenna.

FIG. 4 shows the measured normalized HF gain performance of the first working model compared with the gain of a legacy BCA element. HF gain performance line 40 shows the gain of the first working model, and HF gain performance line 42 shows the gain of the legacy element. Improved gain performance of up to 5 dB is noted in the region from 8-17 MHz. VLF performance was measured at 24 kHz using the station at Cutler, Me. as a beacon. The measurement showed performance comparable to a legacy BCA. (Note that due to the nature of VLF propagation, measurements across the band are not possible and so performance is measured using signals from fixed stations.)

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. A buoyant antenna comprising:

a polymer foam coating;

a VLF/LF element embedded in said polymer foam coating having a first end being capable of joining to the antenna feed and a second end;

a grounding ring in contact with the environment and joined to said VLF/LF element second end for grounding said VLF/LF element;

an HF/VHF element embedded in said polymer foam coating and insulated from electrical contact with said VLF/LF element having a first end being capable of joining to the antenna feed and a second end isolated from said grounding ring and said VLF/LF element wherein said HF/VHF element and said VLF/LF element are helically positioned within said polymer foam coating about a center of said polymer foam coating with a constant pitch angle between said elements;

a blocking choke interposed between said VLF/LF element first end and the antenna feed for blocking HF and VHF radio signals from the VLF/LF element;

a plurality of small chokes regularly positioned on said VLF/LF element; and a plurality of reactive loads positioned in said HF/VHF element at regular intervals for optimizing performance of the antenna in the HF/VHF radio bands.

2. The apparatus of claim 1 wherein each said reactive loads comprises a capacitor.

3. The apparatus of claim 2 wherein a portion of said reactive loads further comprise an inductor positioned in parallel with said capacitor.

4. The apparatus of claim 1 wherein each said reactive load further comprises an inductor positioned in parallel with said capacitor.

* * * * *